US008736519B2

(12) United States Patent
Byun et al.

(10) Patent No.: US 8,736,519 B2
(45) Date of Patent: May 27, 2014

(54) PIXEL DRIVING CIRCUIT WITH GROUND TERMINAL VOLTAGE CONTROLLER FOR AN ELECTRO-LUMINANCE DISPLAY DEVICE

(75) Inventors: Seung-Chan Byun, Incheon (KR); Kyung-Man Kim, Seoul (KR); Seong-Ho Baik, Gyeonggi-Do (KR); In-Hwan Kim, Seoul (KR)

(73) Assignee: LG Display Co., Ltd., Seoul (KR)

( * ) Notice: Subject to any disclaimer, the term of this patent is extended or adjusted under 35 U.S.C. 154(b) by 755 days.

(21) Appl. No.: 11/819,933

(22) Filed: Jun. 29, 2007

(65) Prior Publication Data

US 2008/0001859 A1 Jan. 3, 2008

(30) Foreign Application Priority Data

Jun. 30, 2006 (KR) ..... 10-2006-0061406

(51) Int. Cl.
*G09G 3/30* (2006.01)

(52) U.S. Cl.
USPC ..... 345/76

(58) Field of Classification Search
USPC ..... 345/76
See application file for complete search history.

(56) References Cited

U.S. PATENT DOCUMENTS

| | | | | |
|---|---|---|---|---|
| 6,830,834 | B2 * | 12/2004 | Li et al. | 428/690 |
| 7,812,799 | B2 * | 10/2010 | Ko et al. | 345/82 |
| 2002/0118150 | A1 * | 8/2002 | Kwon | 345/76 |
| 2004/0001037 | A1 * | 1/2004 | Tsujimura et al. | 345/76 |
| 2004/0041525 | A1 * | 3/2004 | Park et al. | 315/169.3 |
| 2004/0251846 | A1 * | 12/2004 | Choi et al. | 315/169.3 |
| 2006/0017665 | A1 * | 1/2006 | Ko et al. | 345/76 |
| 2006/0238461 | A1 * | 10/2006 | Goh et al. | 345/76 |
| 2006/0262050 | A1 * | 11/2006 | Ogawa et al. | 345/76 |

FOREIGN PATENT DOCUMENTS

| | | |
|---|---|---|
| CN | 1361510 | 7/2002 |
| CN | 1448900 | 10/2003 |
| CN | 1479270 A | 3/2004 |
| KR | 10-2005-0070342 | 7/2005 |
| KR | 10-2006-0064683 | 6/2006 |

* cited by examiner

*Primary Examiner* — Kwang-Su Yang
(74) *Attorney, Agent, or Firm* — McKenna, Long & Aldridge, LLP.

(57) ABSTRACT

An organic electro luminance display device according to the present invention comprises a plurality of gate lines and data lines to define a plurality of pixels and a plurality of power lines to apply a signal to the pixels; a data driving unit for supplying the signal to the data line; an emitting unit at each pixel to emit; a first thin film transistor at each pixel, the first thin film transistor being turned on by the signal inputted through the gate line; a second thin film transistor at each pixel, the second thin film transistor being turned on to apply the signal to the emitting signal through the power line when the first thin film transistor is turned on; a ground terminal voltage controlling unit for controlling a first ground terminal voltage and a second ground terminal voltage to determine respectively the voltage output from the data driving unit and the voltage applied to the emitting unit according to the first ground terminal voltage and the second ground terminal voltage, wherein the second ground terminal voltage is higher than the first ground terminal voltage to apply the voltage lower than a reference voltage to the second thin film transistor.

9 Claims, 4 Drawing Sheets

PIXEL DRIVING CIRCUIT WITH GROUND TERMINAL VOLTAGE CONTROLLER FOR AN ELECTRO-LUMINANCE DISPLAY DEVICE

This application claims the benefit of Korean Patent Application No. 10-2006-61406, filed on Jun. 30, 2006, which is hereby incorporated by reference for all purposes as if fully set forth herein.

BACKGROUND OF THE INVENTION

1. Field of the Invention

The present invention relates to an organic electro luminance display device, and more particular to the organic electro luminance display device in which the stress of a driving transistor may be deceased and the remaining image in a screen may be prevented.

2. Discussion of the Related Art

Since the organic electro luminance display device had been introduced using conjugate polymer such as poly-phenyl vinyl (PPV), the organic material such as the conjugate polymer has been study vividly. Further, this organic material can be applied in various applications such as a thin film transistor, a sensor, a laser, a photoelectric device, and an organic electro luminance display device.

In case inorganic electro luminance display device made of phosphors series, since the high driving voltage should be applied to operate the device, the power consumption may be increased. Further, since the inorganic electro luminance display device is made with vacuum evaporation process, the cost is increased and it is difficult to fabricate the large size device. In addition, there is a problem that it is impossible to emit blue color in the inorganic electro luminance display device.

Comparing with the inorganic electro luminance display device, the organic electro luminance display device has some advantages, for example, high emitting efficiency, simplified process capable of large size device, blue light emitting. In addition, the flexible display device can be manufactured in the organic electro luminance display device. Thus, the organic electro luminance display device has been extensively studied as the next-generation flat panel display device. In particular, the active matrix organic electro luminance display device has been introduced as the flat panel display device.

The active matrix organic electro luminance display device can be classified a voltage driving mode, a current driving mode, and a digital driving mode in accordance with the driving method.

The voltage driving mode organic electro luminance display device of the various driving mode is mostly used, since the data can be written in high speed and the driving IC similar with the commercial driving IC used for a liquid crystal display device can be used.

FIG. 1 is a view showing a pixel 1 of the related art organic electro luminance display device. As shown in FIG. 1, the pixel 1 of the organic electro luminance display device is defined by a gate line GL and a data line DL crossing each other and the power line is disposed parallel to the data line DL in the pixel 1. In the pixel, two thin film transistors (TFTs) T1 and T1 and an emitting unit OLED are formed. These TFTs T1 and T2 take a different role in the pixel 1. That is, the second TFT T2, which is a switching TFT, sinks a scan signal supplied through the data line DL and the first TFT T1, which is driving thin film transistor, supplies the excitation signal to the emitting unit through the power line PL when the switching TFT is switched on.

A storage capacitor Cstg is disposed between the gate and the source of the driving TFT T1 to store and maintain the driving voltage of the driving TFT T1.

Hereinafter, the operation of the related art organic electro luminance display device will be described in detail.

When the gate signal GATE of 'high' state is applied to the gate line GL, the switching TFT T2 is turned on and then the driving TFT T1 sinks the sink current from the data line DL. At this time, the current of same amount is supplied to the all pixel of the organic electro luminance display device, since the sink current from the date driving IC is identical.

Thereafter, when the gate signal GATE of 'low' state is applied to the gate line GL, the switching TFT T2 is turned off. At this time, the driving TFT supplies the current corresponding to the voltage charged in the storage capacitor Cstg into the emitting unit OLED to emit the light.

However, there are some problems in the related organic electro luminance display device as follow.

When the data signal is black, the driving TFT T1 is turned off. That is, when the voltage of 0V V applied to the gate of the driving TFT T1, the voltage is not supplied to the emitting unit OLED so that the black is displayed in the organic electro luminance display device. In case of the black data signal, however, the voltage having some amount, not 0V, is applied to the driving TFT T1 by the surrounding environment and the error of the parts of the organic electro luminance display device. Thus, it is difficult to display black in the organic electro luminance display device. In addition, in the related organic electro luminance display device, the life of the driving TFT T1 may be decreased because of the continuous stress thereto.

In the organic electro luminance display device, since only the positive voltage is applied to the driving TFT T1, the threshold voltage of the driving TFT T1 is shifted so that the brightness of the organic electro luminance display device is deteriorated and the life of the organic electro luminance display device is decreased. In addition, the storage capacitor is only charged with the positive voltage, not discharged. Thus, the life of the organic electro luminance display device is decreased by deterioration the storage capacitor Cstg and the ghosting is generated.

SUMMARY OF THE INVENTION

An advantage of the present invention is to provide an organic electro luminance display device in which the stress of the driving TFT can be decreased and the ghosting can be prevented.

To achieve these and other advantages and in accordance with the purpose of the present invention, as embodied and broadly described, an organic electro luminance display device according to the present invention includes: a plurality of gate lines and data lines to define a plurality of pixels and a plurality of power line to apply signal to the pixels; a data driving unit for supplying the signal to the data line; an emitting unit at each pixel to emit; a first thin film transistor at each pixel, the first thin film transistor being turned on by the signal inputted through the gate line; a second thin film transistor at each pixel, the second thin film transistor being turned on to apply the signal to the emitting signal through the power line when the first thin film transistor is turned on; a ground terminal voltage controlling unit for controlling a first ground terminal voltage and a second ground terminal voltage to determine respectively the voltage output from the data driving unit and the voltage applied to the emitting unit according to the first ground terminal voltage and the second ground terminal voltage, wherein the second ground terminal voltage is higher than the first ground terminal voltage to apply the voltage lower than a reference voltage to the second thin film transistor.

It is to be understood that both the foregoing general description and the following detailed description are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings.

DETAILED DESCRIPTION OF THE ILLUSTRATED EMBODIMENTS

Reference will now be made in detail to an embodiment of the present invention, examples of which are illustrated in the accompanying drawings.

Figure 1:
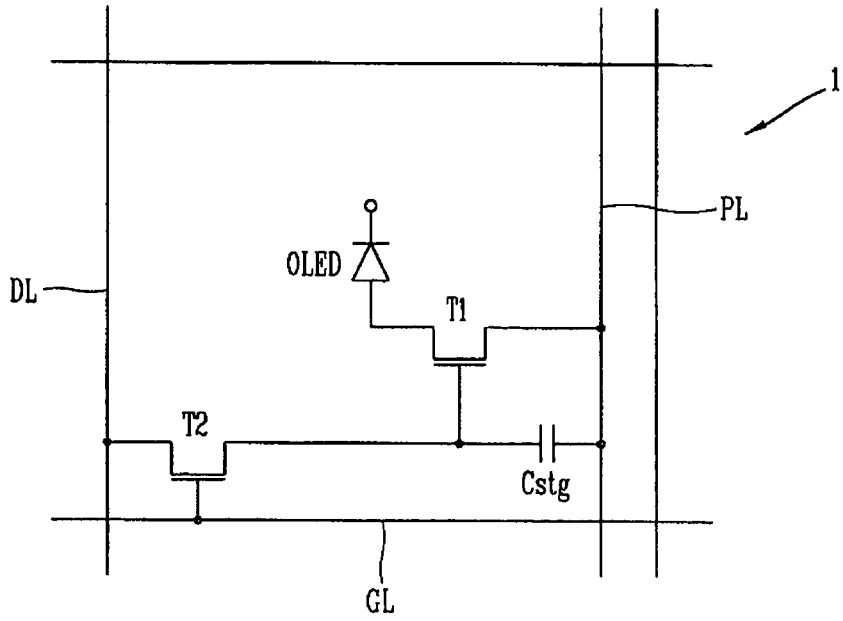
FIG. 1 RELATED ART
FIG. 1 is a view showing one pixel of the related organic electro luminance display device.
Figure 2:
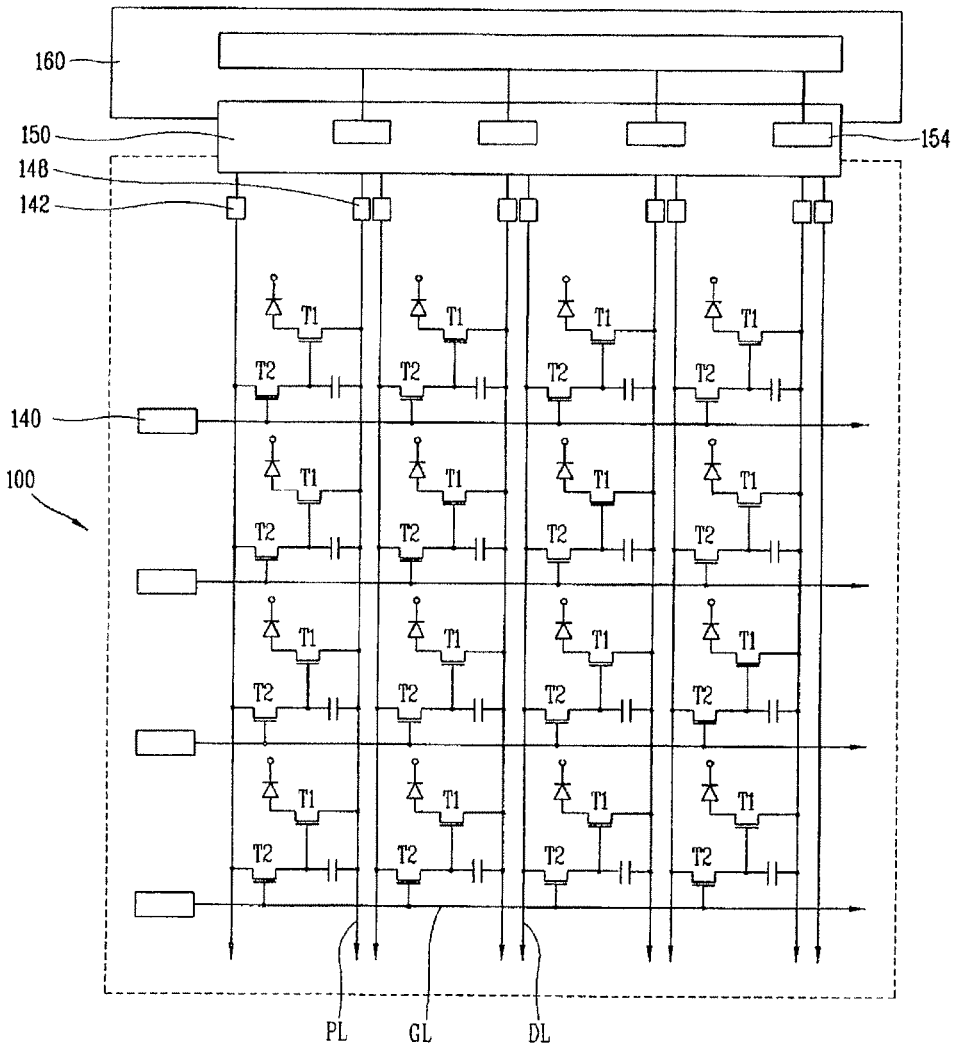
FIG. 2 is a view showing an organic electro luminance display device according to the present invention.

Referring to FIG. 2, the organic electro luminance display device includes a panel 100 having a plurality of pixels to display an image and a printed circuit board 160 having outer driving circuit to apply the signal into the driver in the panel 100.

The panel 100 of the organic electro luminance display device includes a plurality of pixels defined by a plurality of gate lines GL and data lines DL crossing each other and a driving unit such as a switching TFT T2 and a driving TFT T1 disposed at each pixel. Further, a power line PL is disposed in parallel with the data line DL in the panel 100 to supply the signal to the driving TFT T2 in the pixel. Bonding pads 140, 142, and 148 are formed at the end portion of the gate line GL, the data line DL, and the power line PL to connect of the gate line GL, the data line DL, and the power line PL with the outer driving circuit in the outer printed circuit board 160.

A number of methods that may be used for connecting the gate line GL, the data line DL, and the power line PL to the printed circuit board 160 through the pads 140, 142, and 148. For example, Tape-Automatic Bonding using a TCP (Tape Carrier Package) may be adapted in this invention.

The panel 100 and the printed circuit board 160 are connected by the TCP 150. A data driving unit 154 is mounted on the TCP 150 to apply a data signal to the data line DL in the panel through the data pad 142. Not shown in figure, a scan signal is applied to the gate line GL from an external gate driving unit through the gate pad 140. Further, a controlling unit for controlling the data driving unit 154 and the gate driving unit is mounted on the printed circuit board 160.

Figure 3:
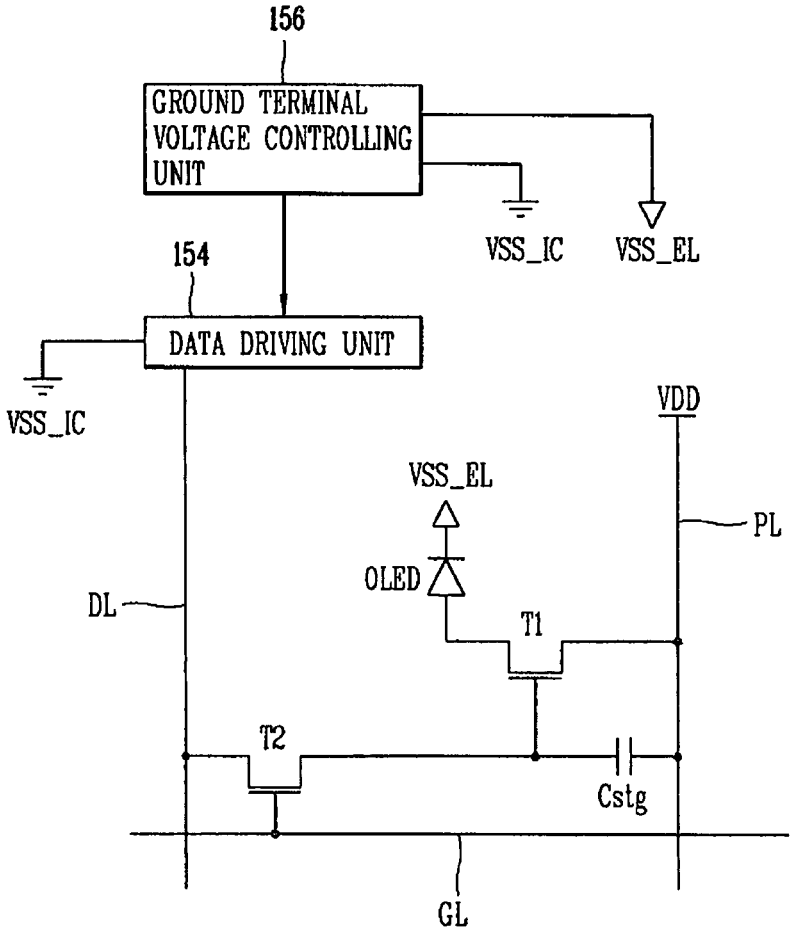
FIG. 3 is a view showing a circuit of one pixel of the organic electro luminance display device according to the present invention.

FIG. 3 is a view showing the one pixel and the data driving unit of the organic electro luminance display device of FIG. 2. Although the data driving unit may be connected with a plurality of pixel, we denoted only one pixel in figure for convenience.

As shown in FIG. 3, a pixel of the organic electro luminance display device may be defined by a gate line GL crossing a data line DL. Each pixel includes: a driving TFT T1 for supplying the driving current to the emitting unit OLED; a switching TFT T2 to be turned on by the gate signal GATE to apply the driving voltage, supplied through the data line DL, to the gate of the driving TFT T1; a storage capacitor Cstg to be connected to the gate of the driving TFT T1 to charge the driving voltage of the driving TFT T1; and a emitting unit OLED for emitting light by the signal applied through the power line PL when the driving TFT T1 is turned on. Further, the organic electro luminance display device includes a date driving unit 154 for supplying a data voltage to the data line DL, a ground terminal voltage controlling unit 156 for outputting a signal to the data driving unit 154 to control separately a ground terminal voltage Vss_EL provided to the driving TFT T1 and a ground terminal voltage Vss_IC to be used in the data driving unit 154 as a reference voltage.

In the illustrated organic electro luminance display device according to the present invention, when the gate signal GATE of 'high' is applied to the switching TFT T2 through the gate line GL, the switching TFT T2 is turned on. As a result, the data signal is applied to the driving TFT T1 through the data line DL and the switching TFT T2 from the data driving unit 154. At this time, since the amount of the current supplied to the data line DL is uniform, the amount of the current applied to all pixels is same. Thus, the voltage corresponding to the current applied to the pixel is charged to the storage capacitor Cstg.

Thereinafter, when the 'low' gate signal GATE is applied to the switching TFT T2 through the gate line GL, the switching TFT T2 is turned off and then the driving TFT T1 supplies a current that corresponds to the voltage charged in the storage capacitor Cstg to the emitting unit OLED to emit the light from the emitting unit OLED.

The ground terminal voltage is determined in the ground terminal voltage controlling unit 156. The data driving unit 154 outputs the data voltage Vdata to the data line DL in accordance with the first ground terminal voltage Vss_IC which is a reference voltage determined in the ground terminal voltage controlling unit 156. The voltage supplied to the emitting unit OLED in accordance with the second ground terminal voltage Vss_EL is determined in the ground terminal voltage controlling unit 156 and the brightness is determined by the data voltage Vdata.

The second ground terminal voltage Vss_EL is higher than the first ground terminal voltage Vss_IC, i.e., Vss_EL=Vss_IC+Va. Thus, the voltage Vgs between the gate and the source of the driving TFT T1, which is voltage substantially applied to the driving TFT T1, is Vgs=Vdata−Va. In other word, the illustrated organic electro luminance display device according to the present invention has a voltage Vgs, that is Va lower than the voltage of the related art organic electro luminance display device.

Since the voltage Vgs of the organic electro luminance display device of FIG. 3 is Va lower than that of the related art organic electro luminance display device, the negative voltage is applied to the driving TFT T1 using the data voltage Vdata is lower than the voltage Va. Thus, both a positive voltage and the negative voltage may applied to the gate of the driving TFT T1 in the organic electro luminance display device according to the current invention, while only a positive voltage is applied to the gate of the driving TFT in the related organic electro luminance display device.

In the related art, since the first ground terminal voltage Vss_IC is the same as the second ground terminal voltage Vss_EL, the data voltage applied to the gate of the driving TFT T1 is not 0V when the black signal is applied to the data line DL from the data driving unit 154. In this invention, however, since the voltage corresponding to the gray 0 can be lower than that of the related art by the data modulation, the voltage lower than the reference voltage is applied to the driving TFT T1 and as a result it is possible to obtain the effect such that 0V voltage is applied to the driving TFT T1.

In this invention, that is, the voltage to the gate of the driving TFT T1 cannot be precisely controlled in 0V. However, since the ground terminal voltage controlling unit 156 controls the second ground terminal voltage Vss_EL to control the gate-source voltage Vgs of the driving TFT T1, it is possible to obtain the effect such that 0V voltage is applied to the driving TFT T1.

As described above, in this invention the negative voltage may be applied to the gate of the driving TFT T1 so that the stress of the driving TFT T1 can be decreased. Further, the data voltage is rapidly discharged at the storage capacitor Cstg because the negative voltage is applied to the storage capacitor Cstg.

Figure 4:
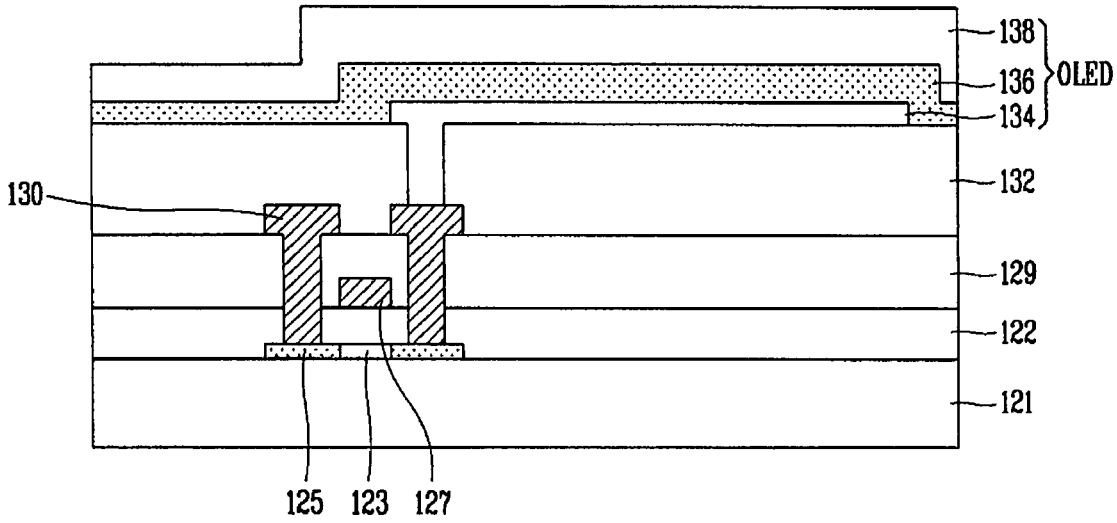
FIG. 4 is a sectional view of a driving TFT and an emitting unit of organic electro luminance display device according to the present invention.

FIG. 4 is a sectional view of an emitting unit of an organic electro luminance display device according to the present invention. We illustrate the driving TFT T1 in the figure for convenience.

As shown in FIG. 4, a semiconductor layer 123 formed on a transparent substrate 121 such as a glass and impurity doped semiconductor layers 125 formed at each of two sides of the semiconductor layer 123. Over the substrate 121, a gate insulating layer 122 is formed to cover the semiconductor layer 123 and the impurity semiconductors 125. A gate electrode 127 is formed in the region of the semiconductor layer 123 on the gate insulating layer 122 and an interlayer insulating layer 129 is formed over the whole area of the substrate 121. Source/drain electrodes 130 are formed on the interlayer insulating layer 129 and connected electrically to the impurity semiconductors 125 through contact holes in the gate insulating layer 122 and the interlayer insulating layer 129.

A passivation layer 132 is formed on the interlayer insulating layer 129 and the emitting unit OLED is formed on the passivation layer 132. The emitting unit OLED is connected to the source/drain electrodes 130 through the contact hole in the passivation layer 132.

The emitting unit OLED includes an anode 134 connected to the source/drain electrodes 130 on the passivation layer 132, an emitting layer 136 on the anode 134 to emit the light when the voltage is applied, and a cathode on the emitting layer 136 to apply the voltage to the emitting layer 136. The anode 134 is made of a metal having low work function such as indium tin oxide and the cathode 138 is made of the metal having high work function.

In the organic electro luminance display device according to the present invention, when a voltage is applied to the gate electrode 127 to supply the excitation signal to the anode 134 and the cathode 138 through the source/drain electrodes 130, holes and electrons are respectively injected to the emitting layer 136 from the anode 134 and the cathode 138 to generate an exciton within the emitting layer 136. The excition is annihilated in the emitting layer 136 to emit light corresponding to the energy difference between a lowest unoccupied molecular orbital and a highest occupied molecular orbital.

Since the reference voltages determining the voltage applied to the data line and the emitting unit, i.e., the first ground terminal voltage Vss_IC and the second ground terminal voltage Vss_EL are set to different values, the voltage applied to the gate of the driving TFT T1 can be controlled. Accordingly, the stress to the driving TFT can be decreased and the ghosting is prevented.

Although N-MOS TFT is described as the switching TFT and driving TFT in description, this invention is adapted to the various TFT, not limited this TFT.

It will be apparent to those skilled in the art that various modifications and variation can be made in the present invention without departing from the spirit or scope of the invention. Thus, it is intended that the present invention cover the modifications and variations of this invention provided they come within the scope of the appended claims and their equivalents.

What is claimed is:

1. An organic electro-luminance display device comprising:

a plurality of gate lines and a plurality of data lines that cross to define a plurality of pixels and a plurality of power lines to apply signal to the pixels;

a data driving unit for supplying a plurality of data signals to the data lines, respectively;

an emitting unit at each pixel that emits light;

a first thin film transistor at said each pixel, the first thin film transistor being turned on by a gate signal on one of the gate lines;

a second thin film transistor at said each pixel, the second thin film transistor being turned on to apply a signal to the emitting unit from one of the power lines when the first thin film transistor is turned on; and a ground terminal voltage controlling unit that controls a first ground terminal voltage Vss_IC and a second ground terminal voltage Vss_EL, wherein the data driving unit is supplied with the first ground terminal voltage Vss_IC from the ground terminal voltage controlling unit and outputs the data signal to the data line in accordance with the first ground terminal voltage Vss_IC which is a reference voltage determined in the ground terminal voltage controlling unit, and the emitting unit is supplied with the second ground terminal voltage Vss_EL from the ground terminal voltage controlling unit and emits light with a brightness determined by a voltage of the data signal with respect to the second ground terminal voltage Vss_EL, and wherein the second ground terminal voltage Vss_EL is higher than the first ground terminal voltage Vss_IC, Vss_EL=Vss_IC+Va, the second ground terminal voltage controls a gate-source voltage Vgs of the second thin film transistor, and the gate-source voltage Vgs is lowered by Va than a gate-source voltage controlled by the first ground terminal voltage Vss_IC, where Va is a positive voltage.

2. The device of claim 1, further comprising:

a storage capacitor between the gate and the drain of the second thin film transistor in said each pixel.

3. The device of claim 1, wherein at least one of the first and second thin film transistors includes N-MOS thin film transistor.

4. The device of claim 3, wherein the second thin film transistor comprising:

a substrate;

a semiconductor on the substrate;

a gate insulating layer on the semiconductor;

a gate electrode on the semiconductor;

an interlayer on the gate electrode; and a source electrode and a drain electrode on the interlayer.

5. The device of claim 4, wherein the second thin film transistor further including a passivation layer over the substrate to cover the second thin film transistor.

6. The device of claim 1, wherein the emitting unit comprising:

an anode on the passivation;

an emitting layer on the anode; and a cathode on the emitting layer.

7. The device of claim 6, wherein the anode is connected to the source/drain electrodes of the second thin film transistor through a contact hole in the passivation.

8. The device of claim 6, wherein the anode is made of indium tin oxide.

9. The device of claim 6, wherein the cathode is made of a metal having a low work function.

* * * * *